United States Patent [19]

Shiratsuki

[11] Patent Number: 4,549,189

[45] Date of Patent: Oct. 22, 1985

[54] THERMAL PRINTING HEAD

[75] Inventor: Yoshiyuki Shiratsuki, Ebina, Japan

[73] Assignee: Fuji Xerox Co., Ltd., Tokyo, Japan

[21] Appl. No.: 500,291

[22] Filed: Jun. 2, 1983

[30] Foreign Application Priority Data

Jun. 4, 1982 [JP] Japan ..... 57-95703

[51] Int. Cl.[4] ..... H05B 1/00

[52] U.S. Cl. ..... 346/76 PH; 214/543; 338/309

[58] Field of Search ..... 400/120; 346/76 R, 76 PH; 219/216, 216 PH, 243, 543, 552, 553; 338/307–309

[56] References Cited

U.S. PATENT DOCUMENTS

| | | | |
|---|---|---|---|
| 3,296,624 | 1/1967 | Ascoci | 346/140 X |
| 4,024,545 | 5/1977 | Dowling et al. | 346/76 L |
| 4,204,107 | 5/1980 | Ohkubo et al. | 346/76 PH |
| 4,215,350 | 7/1980 | Mielke et al. | 346/75 X |
| 4,296,418 | 10/1981 | Yamazami et al. | 346/75 X |
| 4,322,733 | 3/1982 | Moriguchi et al. | 346/76 PH |
| 4,340,896 | 7/1982 | Cruz-Uribe et al. | 346/140 R |
| 4,376,284 | 3/1983 | Bader et al. | 346/140 R |
| 4,378,564 | 3/1983 | Cross et al. | 346/75 |
| 4,432,005 | 2/1984 | Duffield et al. | 346/140 R |

OTHER PUBLICATIONS

Replaceable Ink Jet Nozzle, IBM, T. J. Kotaser, vol. 15, #3, 8–72.

*Primary Examiner*—E. A. Goldberg
*Assistant Examiner*—A. Evans
*Attorney, Agent, or Firm*—Spensley Horn Jubas & Lubitz

[57] ABSTRACT

A thermal printing head has a plurality of heating resistors formed on an insulating substrate with spaces of a predetermined width being provided between adjacent resistors. In another embodiment, these spaces are filled with intermediate layers of a material such as glass.

With this structure, temperature distribution produced by the heating resistors becomes substantially flat, whereby the power consumption of the thermal printing head can be reduced, and the thermal efficiency can be improved.

16 Claims, 8 Drawing Figures

PRIOR ART

THERMAL PRINTING HEAD

BACKGROUND OF THE INVENTION

This invention relates to a thick film type thermal printing head which is used for a thermal printer.

FIG. 1 is a plan view of a typical conventional thick film type thermal printing head and FIG. 2 is a sectional view as seen along line A—A in FIG. 1. In this thermal head, electrodes 2-1, 2-2, 2-3, . . . are arranged in a zigzag manner on a substrate 1. A heating resistor is formed to connect the electrodes 2-1, 2-2, 2-3, . . . . Further, the electrodes 2-1, 2-2, 2-3, . . . and the heating resistor 3 are covered with a protecting layer 4. The substrate 1 is formed of alumina, the electrodes 2-1, 2-2, 2-3, . . . are formed of gold and the heating resistor 3 are formed of ruthenium. The sub scanning direction (i.e., feeding direction of a heat-sensitive sheet) is designated by an arrow B in FIG. 1.

The printing of image on a heat-sensitive sheet by the thermal printing head is performed as follows: The heat-sensitive sheet is provided to contact with the protecting layer 4 on the heating resistor 3, and is scanned in the direction designated by the arrow B. Then, electric current in the form of pulse is applied through the electrodes 2-1, 2-2, 2-3, . . . to a desired portion (e.g., a heating portion 3-1) of the heating resistor 3, and the corresponding portion of the heat-sensitive sheet is colored by Joule heat which is produced in the above portion of the heating resistor 3, whereby the image is reproduced on the heat-sensitive sheet as desired.

FIG. 3 shows a temperature distribution on the surface of the heating portion 3-1 when the above portion of the resistor 3 is energized by the electric current through the electrodes 2-1 and 2-2 in the conventional thermal printing head. As evident from FIG. 3, the temperature distribution on the surface of the heating portion 3-1 is of cone shape with its peak at the center between the electrodes 2-1 and 2-2. Such temperature distribution is formed because of the heat dissipating effect through the electrodes 2-1 and 2-2.

To color a heat-sensitive sheet, it is generally required that a thermal printing head has a predetermined effective coloring length. This effective coloring length is shown as L in FIG. 3, and depends upon the lowest necessary temperature T which is necessary to generate a color on the heat-sensitive sheet. However, the temperature over the temperature T is not necessary for the coloring, causing the loss of electric power. The amount of this loss is shown by the shaded part P which is surrounded by the curve of the temperature distribution and the line of the lowest necessary temperature T in FIG. 3. Since the temperature distribution curve is cone shaped, the area of the shaded part P, i.e., the amount of loss of the electric power becomes large, with the result that large electric power is required to obtain necessary effective coloring length L, thereby deteriorating the efficiency of the conventional thermal printing head.

Further, because of the cone shape in the temperature distribution, the maximum temperature Tmax in the heating portion is high. This generates large thermal stress in the heating portion of the heating resistor 3, which causes the heating resistor 3 to be cracked, thereby shortening the lifetime of the thermal printing head.

SUMMARY OF THE INVENTION

Accordingly, an object of this invention is to provide a thermal printing head which can eliminate the aforementioned drawbacks and disadvantages of the conventional thermal printing head and by flattening the temperature distribution of a heating portion thereof, thereby achieving high efficiency and long lifetime.

According to this invention, a heating resistor is divided into a plurality of resistor segments. With this structure, each of the heating resistor segments generates peak temperature at the center of the heating portion, and the separating portion between the segments are heated almost to the peak heating temperature of the two heating resistor segments. In this manner, the temperature distribution on the surface of the heating portion becomes substantially a flat shape with the maximum temperature being suppressed, and the loss of electric power is accordingly reduced, whereby the efficiency and the lifetime of the thermal head can be enhanced.

An embodiment of the invention will now be described in detail with reference to the attached drawings.

DESCRIPTION OF THE PREFERRED EMBODIMENTS

Figure 1:
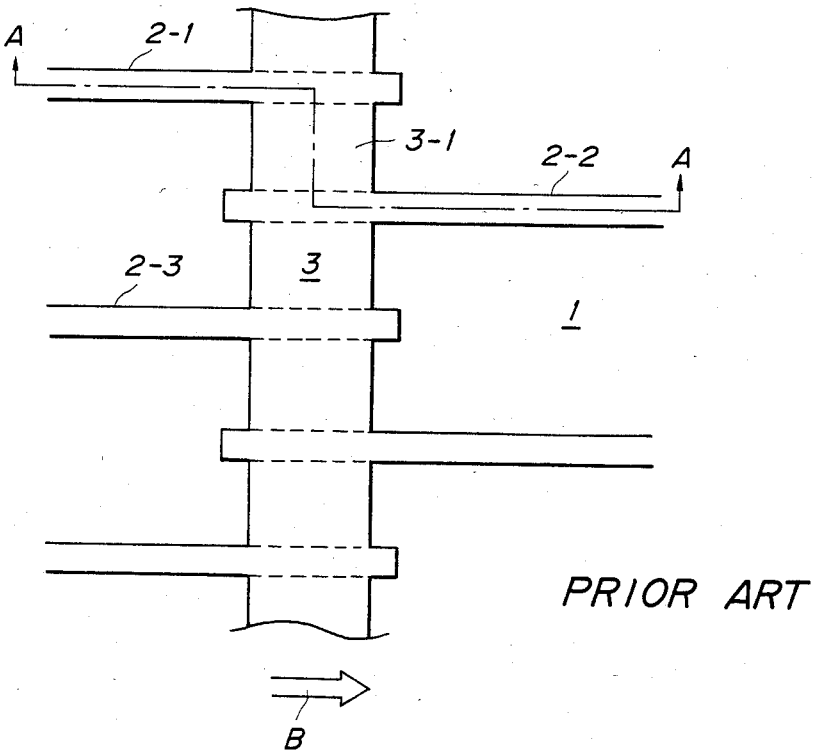
FIGS. 1 and 2 are plan and sectional views of a conventional representative thick film type thermal printing head.
Figure 2:
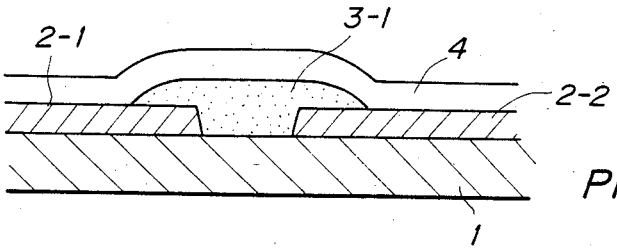
PRIOR ART FIG. 2
Figure 3:
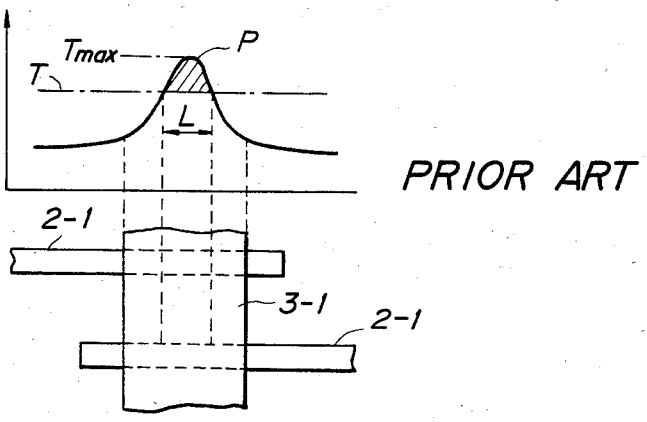
FIG. 3 illustrates the temperature distribution of the heating portion of a conventional thermal printing head.
Figure 4:
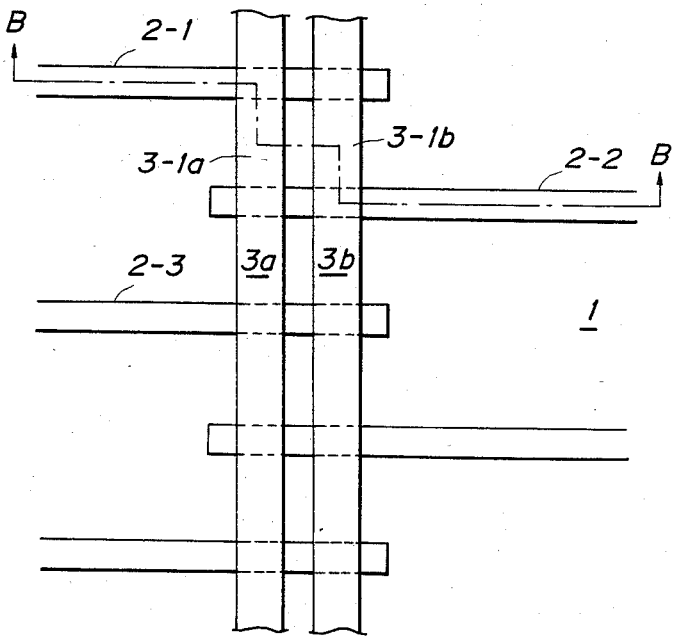
FIGS. 4 and 5 are plan and sectional views of an embodiment of a thermal printing head according to the present invention.
Figure 5:
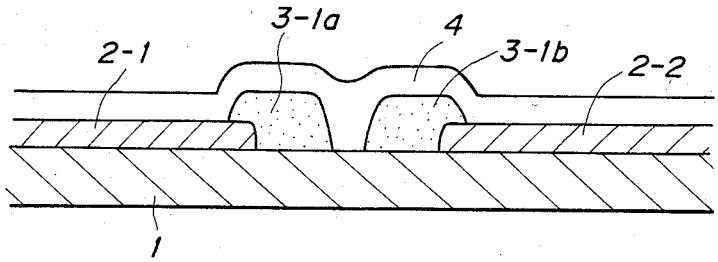

Referring to FIGS. 4 and 5 wherein same reference numerals in FIGS. 1 and 2 are used to designate equal or equivalent parts to those in FIGS. 1 and 2, the thermal printing head of this embodiment of the present invention is constructed so that the heating resistor 3 is divided into two resistor segments **3*a* and 3*b***.

Figure 6:
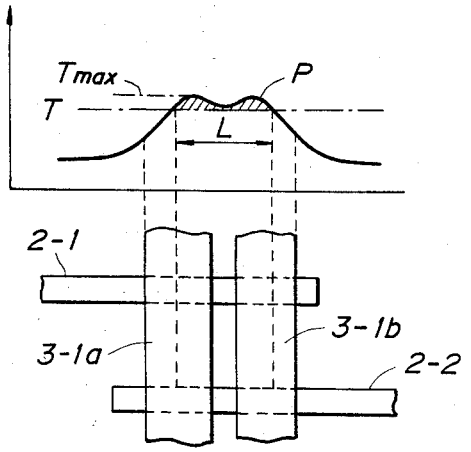
FIG. 6 show the temperature distribution of the heating portion of the thermal printing head shown in FIG. 5.

In this structure of the thermal printing head, each of the resistor segments **3*a* and 3*b* has a peak temperature in the heating portion, with the result that the temperature distribution on the surface of the heating portion substantially becomes a trapezoidal shape as shown in FIG. 6**. In this manner, an area of the shaded part P which is surrounded by the curve of the temperature distribution and the line of the lowest necessary temperature T for coloring a heat-sensitive sheet and hence the loss of the electric power is reduced. In other words, less power consumption is necessary to obtain the same effective coloring length L. Further, the maximum temperature Tmax of the heating portion becomes low, and thermal stress which is produced in the heating portion is accordingly reduced, thereby causing the heating portion to be less likely to be cracked.

Figure 7:
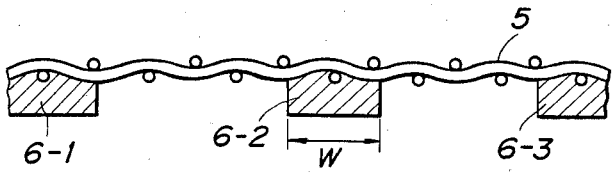
FIG. 7 is a sectional view of a screen for forming a heating resistor of the thermal head in FIG. 5.

FIG. 7 shows a screen mask for forming heating resistor segments 3*a* and 3*b* in FIG. 6 which are separated from each other. A screen mask as shown in FIG. 7 is formed by coating emulsions 6-1, 6-2 and 6-3 on a stainless steel mesh 5. The heating resistor segments 3*a* and 3*b* are formed by the screen mask by means of a screen printing machine (not shown) using a screen printing technique. The emulsion 6-2 is used for separating the heating resistor into two segments.

In this embodiment of the thermal printing head, the temperature distribution on the surface of the heating portion varies depending upon the material and the thickness of the film of the heating resistor as well as the width w of the emulsion 6-2 shown in FIG. 7. The temperature distribution may be formed in a trapezoidal shape in which the center is slightly recessed as shown in FIG. 6 by suitably selecting the above described factors.

Figure 8:
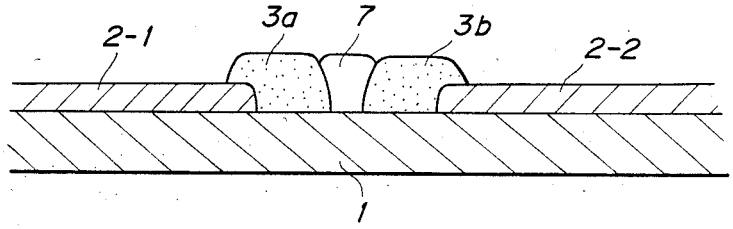
FIG. 8 is a sectional view of another embodiment of the thermal printing head according to the invention.

FIG. 8 shows another embodiment of the present invention. In this embodiment, an intermediate layer 7 which is formed of a glass material is arranged on the intermediate portion between the separated heating resistor segments 3*a* and 3*b*. In this embodiment, a protecting layer which covers the electrodes 2 and the heating resistor segments is not employed. In other words, the layer 7 operates as a wear resistant protecting layer. In the structural advantages of this embodiment, a heat-sensitive sheet is contacted directly with the heating resistor segments 3*a*, 3*b* since no protecting layer is provided, with the result that the thermal efficiency of the thermal head can be further improved.

According to the present invention as described above, the heating resistor is divided into two segments, whereby the temperature distribution curve of the heating portion in the thermal printing head is substantially flat. Accordingly, the loss of electric power can be reduced, and the maximum temperature can be decreased, thereby causing the heating portion not to create large thermal stress and therefore lengthening the lifetime of the thermal printing head.

What is claimed is:

1. A thermal printing head comprising:

an electrode pattern formed on an insulating substrate, each electrode of said electrode pattern being arranged in a direction perpendicular to the scanning direction;

a plurality of heating resistors extending in the scanning direction but spaced apart in said perpendicular direction by a predetermined width between adjacent ones of said resistors and connected to each electrode of said electrode pattern;

a protecting layer for covering heating portions of said plurality of heating resistors, said portions extending between said adjacent electrodes of said electrode pattern and between said adjacent resistors, whereby the temperature distribution on the surface of said heating portions with respect to the direction perpendicular to the scanning direction is substantially flat.

2. A thermal printing head as claimed in claim 1, wherein said electrode pattern is so configured that adjacent electrodes are elongated in the direction opposite to each other with respect to said heating resistors, and the number of said heating resistors, connecting each adjacent electrodes, is two.

3. A thermal printing head comprising:

an electrode pattern formed on an insulating substrate, each electrode of said electrode pattern being arranged in a direction perpendicular to the scanning direction;

a plurality of heating resistors extending in the scanning direction but spaced apart in said perpendicular direction with spaces between adjacent ones being filled with intermediate layers, whereby the temperature distribution, bridging between adjacent one of said heating resistors with respect to the direction perpendicular to the scanning direction, is substantially flat.

4. A thermal printing heat as claimed in claim 3, wherein said intermediate layers are made of glass.

5. A thermal printing head as claimed in claim 3, wherein said electrode pattern is so configured that adjacent electrodes are elongated in the direction opposite to each other with respect to said heating resistors, and the number of said heating resistors, connecting each adjacent electrodes, is two.

6. A thick film thermal printing head comprising:

a plurality of spaced electrodes, at least two closely spaced thick film heating resistors extending between each adjacent pair of said electrodes and being connected thereto, said at least two heating resistors being spaced so that when each of said resistors is heated to a temperature just above the temperature T required to achieve coloring of a heat sensitive sheet, the temperature in the space intermediate said heating resistors will also be above said temperature T, whereby a substantially flat temperature distribution over an entire effective coloring length L is achieved.

7. The thermal printing head of claim 6 further including a protecting layer substantially covering said heating resistors.

8. The thermal printing head of claim 6 wherein said space intermediate said heating resistors is filled with an intermediate layer.

9. A thermal printing head comprising:

a plurality of electrodes spaced in a scanning direction;

a plurality of elongated thin film heating resistors connected to said plurality of electrodes, the elongated thin film heating resistors being closely spaced and dimensioned so that when portions of said heating resistor are electrically heated to just above a certain coloring temperature T, essentially all the space intermediate said portions also will be above said temperature T.

10. The thermal printing head of claim 9 further including a protecting layer substantially covering said heating resistors.

11. The thermal printing head of claim 9 wherein the spaces between said heating resistors are filled with an intermediate layer.

12. A thermal printing head in which the surface of heating portions of said printing head generates heat of substantially flat temperature distribution in a direction transverse to a scanning direction, said thermal printing head comprising:

a plurality of heating resistors each formed on an insulating substrate and extending along said scanning direction with said substantially flat temperature distribution essentially bridging the space between adjacent ones of said resistors; and an electrode pattern which divides said scanning direction each of said heating resistors into a plurality of portions, for selectively supplying electricity to said plurality of portions.

13. A thermal printing head as claimed in claim 12, wherein said plurality of heating resistors are two heating resistors.

14. A thermal printing head as claimed in claim 12, which further comprises an intermediate layer being filled in said space between the heating resistors.

15. A thermal printing head as claimed in claim 14, wherein said intermediate layers are made of glass.

16. A thermal printing head as claimed in claim 12, which further comprises a protecting layer for covering said plurality of heating resistors and said electrode pattern.

* * * * *